US008769893B1

(12) United States Patent
Gill et al.

(10) Patent No.: US 8,769,893 B1
(45) Date of Patent: Jul. 8, 2014

(54) TWIST LOCK PORTABLE BUILDING FOOTING

(71) Applicants: Peter E. Gill, Tamuning, GU (US); Peter E. Gill, III, Milwaukee, WI (US)

(72) Inventors: Peter E. Gill, Tamuning, GU (US); Peter E. Gill, III, Milwaukee, WI (US)

(73) Assignee: Kwikspace Guam, Hagatna, GU (US)

( * ) Notice: Subject to any disclaimer, the term of this patent is extended or adjusted under 35 U.S.C. 154(b) by 13 days.

(21) Appl. No.: 13/861,751

(22) Filed: Apr. 12, 2013

(51) Int. Cl.
*E02D 27/32* (2006.01)
*E02D 27/50* (2006.01)

(52) U.S. Cl.
CPC ..... *E02D 27/50* (2013.01)
USPC ..... 52/297; 52/126.7; 52/298; 248/188.5; 248/354.3

(58) Field of Classification Search
CPC ..... E04F 15/02482; E04F 15/02476; E04F 15/0247; E04F 15/02454; E04B 1/34352; E04B 1/34363; E04B 1/415; E04B 1/4164; E02D 5/30; E02D 27/16; E02D 27/18; E02D 35/00
USPC ..... 52/126.7, 126.6, 126.5, 169.9, 298, 52/294–297; 248/188.5, 354.3
See application file for complete search history.

(56) References Cited

U.S. PATENT DOCUMENTS

| | | | | | |
|---|---|---|---|---|---|
| 3,318,057 | A * | 5/1967 | Norsworthy | 52/126.6 |
| 3,667,730 | A * | 6/1972 | Kollmar | 54/424 |
| 371,325 | A | 1/1973 | Tkach | |
| 3,713,259 | A * | 1/1973 | Tkach | 52/111 |
| 3,899,857 | A * | 8/1975 | Mochizuki | 52/126.6 |
| 4,258,516 | A * | 3/1981 | Mori et al. | 52/126.6 |
| 4,348,841 | A * | 9/1982 | Ueno et al. | 52/126.5 |
| 4,558,544 | A * | 12/1985 | Albrecht et al. | 52/126.6 |
| 4,987,708 | A * | 1/1991 | Wilcox | 52/126.6 |
| 5,117,596 | A * | 6/1992 | Leslie et al. | 52/126.6 |
| 5,152,108 | A * | 10/1992 | Madl, Jr. | 52/126.1 |
| 5,398,466 | A * | 3/1995 | Oyama et al. | 52/126.6 |
| 5,516,069 | A * | 5/1996 | Hanna | 248/354.3 |
| 556,195 | A | 10/1996 | Collins et al. | |
| 5,862,635 | A * | 1/1999 | Linse et al. | 52/126.6 |
| 6,094,873 | A * | 8/2000 | Hoffman et al. | 52/126.6 |
| 7,454,869 | B2 * | 11/2008 | Owen | 52/263 |
| 8,161,698 | B2 * | 4/2012 | Migliore | 52/295 |
| 8,397,442 | B2 * | 3/2013 | Laurin | 52/126.6 |
| 2002/0092250 | A1 * | 7/2002 | Stuever | 52/299 |
| 2003/0070372 | A1 * | 4/2003 | Favero | 52/220.1 |
| 2004/0163333 | A1 * | 8/2004 | Whittaker et al. | 52/126.5 |
| 2008/0222973 | A1 * | 9/2008 | Lee et al. | 52/126.1 |
| 2009/0211178 | A1 * | 8/2009 | Marshall et al. | 52/126.6 |
| 2011/0023387 | A1 * | 2/2011 | Sweeney et al. | 52/167.4 |
| 2011/0185675 | A1 * | 8/2011 | Knight et al. | 52/741.1 |

* cited by examiner

*Primary Examiner* — William Gilbert
(74) *Attorney, Agent, or Firm* — Donald J. Ersler

(57) ABSTRACT

A twist lock portable building footing preferably includes a block anchor device, a threaded adjustment shaft, a pocket projection device and a cast concrete block. The block anchor device preferably includes a threaded tube, a plurality of rebar projections. The pocket projection device preferably includes a support base, an H-shaped spherical roller bearing and a twist lock projection. The support base includes a base threaded tube. The block anchor device is cast in the cast concrete block. One end of the threaded adjustment shaft is threaded into the threaded tube and the other end is threaded into the base threaded tube. The block anchor device is cast in the cast concrete block. The twist lock portable building footings are positioned, such that projection members of the twist locks may be inserted into grappler pockets of a cargo container.

6 Claims, 3 Drawing Sheets

TWIST LOCK PORTABLE BUILDING FOOTING

BACKGROUND OF THE INVENTION

1. Field of the Invention

The present invention relates generally to supporting portable buildings and more specifically to a twist lock portable building footing, which may be angularly adjusted to be inserted into a grappler pocket of a cargo container.

2. Discussion of the Prior Art

U.S. Pat. No. 3,713,259 to Tkach discloses a combination anchor and support utilized to secure a mobile home to an underlying foundation. U.S. Pat. No. 5,561,950 to Collins et al. discloses a method and apparatus for adjustable pier block.

Accordingly, there is a clearly felt need in the art for a twist lock portable building footing, which may be angularly adjusted to be inserted into and locked in a grappler pocket of a cargo container.

SUMMARY OF THE INVENTION

The present invention provides a twist lock portable building footing, which may be angularly adjusted to be inserted into a grappler pocket of a cargo container. The twist lock portable building footing preferably includes a block anchor device, a threaded adjustment shaft, a pocket projection device and a cast concrete block. The block anchor device preferably includes a threaded tube, a plurality of lower rebar projections and a plurality of upper rebar projections. The plurality of rebar projections extend from an outer perimeter of the threaded tube. An inner diameter of the threaded tube is sized to threadably engage the threaded adjustment shaft. The pocket projection device preferably includes a support base, an H-shaped spherical roller bearing and a twist lock projection.

The support base includes an attachment plate and a base threaded tube. The base threaded tube extends downward from the attachment plate. The H-shaped spherical bearing includes a mounted spherical roller bearing and an upper attachment plate. The mounted spherical roller bearing includes a spherical bearing tube and a mounting flange. The upper attachment plate is welded to an end of the spherical bearing tube. However, the H-shaped spherical bearing may not be necessary. The twist lock projection includes a twist lock and twist lock mounting plate. The twist lock mounting plate is welded to a bottom of the twist lock.

The twist lock portable building footing is preferably assembled in the following manner. The block anchor device is cast in the cast concrete block. One end of the threaded adjustable shaft is threaded into the threaded tube of the block anchor device and the other end of the threaded adjustable shaft is threaded into the threaded tube of the pocket projection device. The mounting flange of the H-shaped spherical bearing is attached to the attachment plate of the support base with a plurality of fasteners. The twist lock mounting plate is attached to the upper attachment plate of the H-shaped spherical bearing with a plurality of fasteners. The twist lock portable building footings are positioned, such that projection members of the twist locks may be inserted into grappler pockets of a cargo container.

Accordingly, it is an object of the present invention to provide a twist lock portable building footing, which may be angularly adjusted to be inserted into and locked in a grappler pocket of a cargo container.

These and additional objects, advantages, features and benefits of the present invention will become apparent from the following specification.

DETAILED DESCRIPTION OF THE PREFERRED EMBODIMENTS

Figure 1:
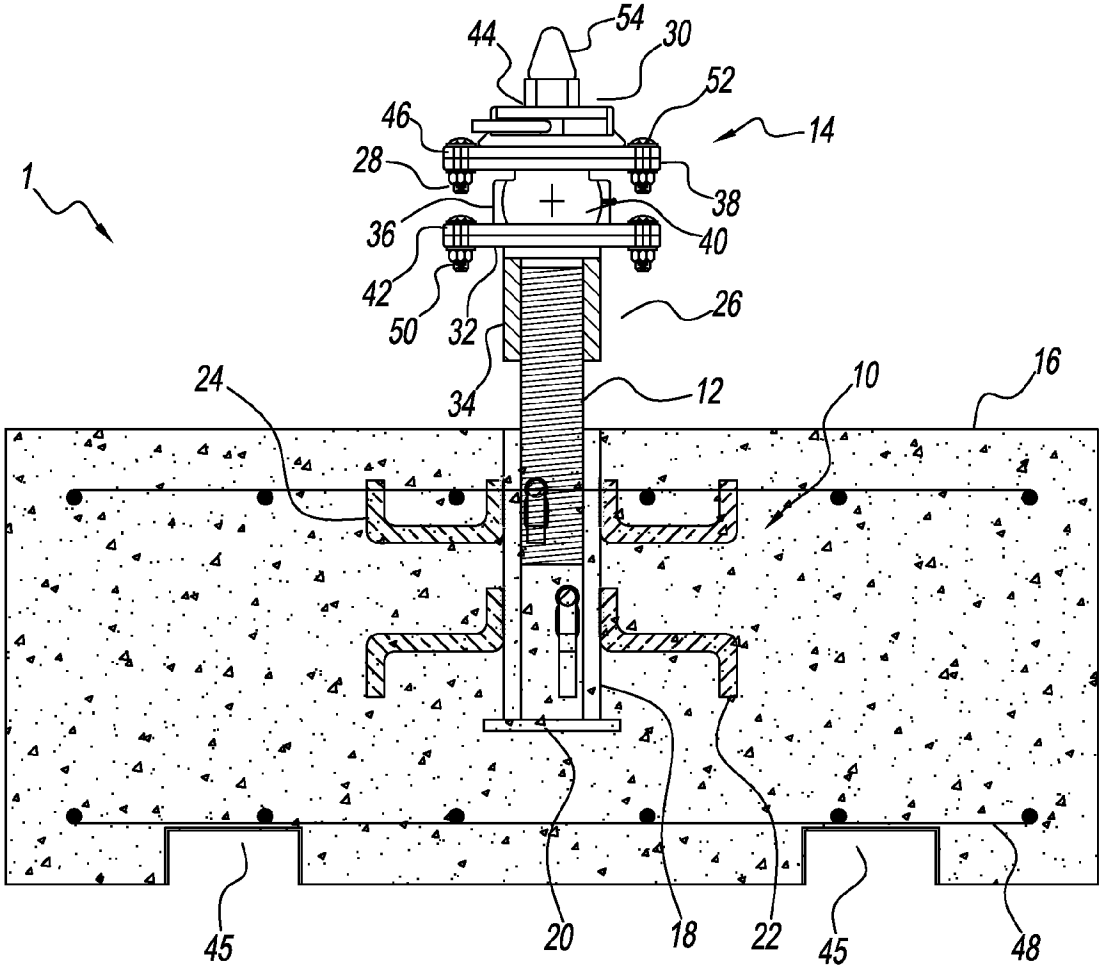
FIG. 1 is a cross sectional view of a twist lock portable building footing in accordance with the present invention.
Figure 2:
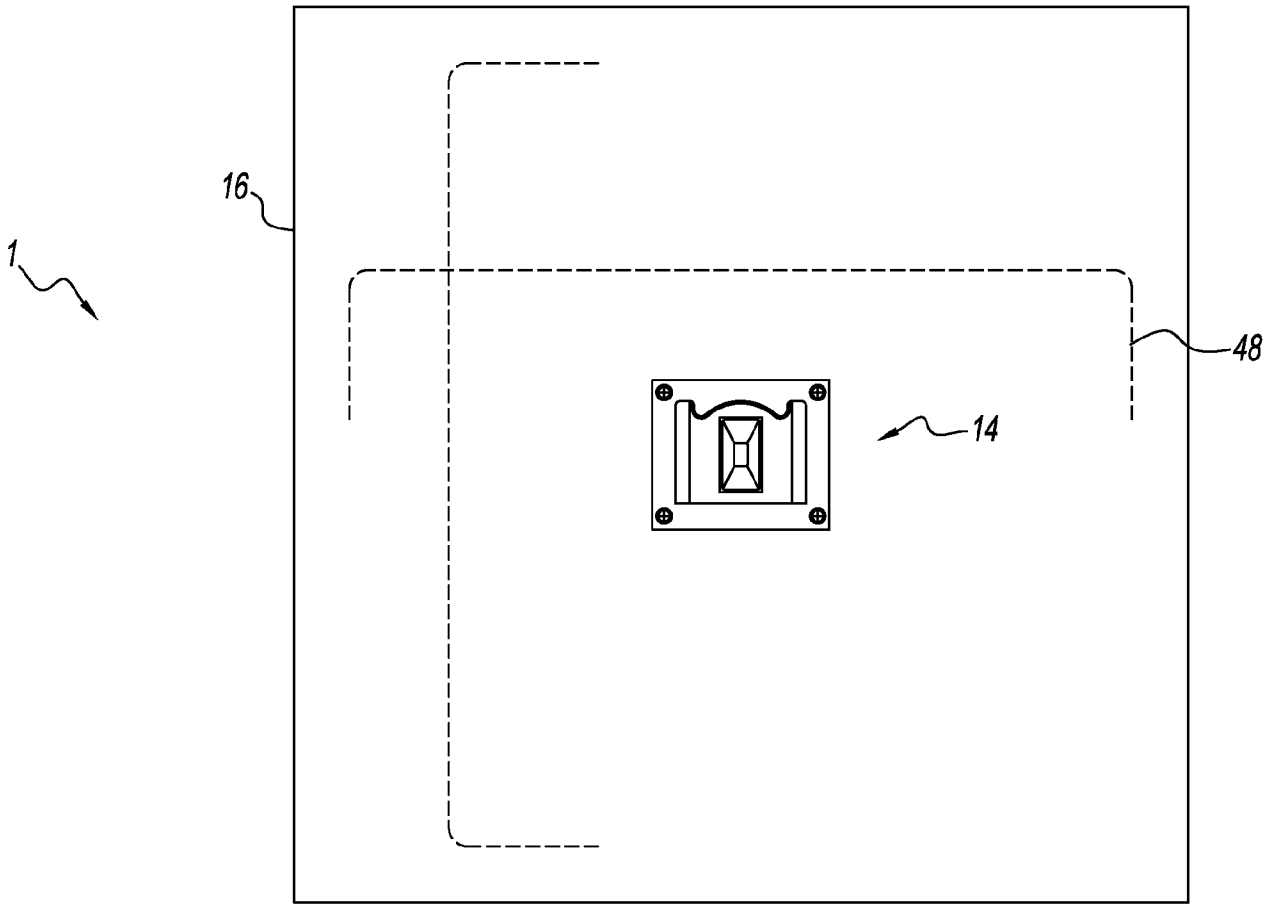
FIG. 2 is a top view of a twist lock portable building footing in accordance with the present invention.
Figure 3:
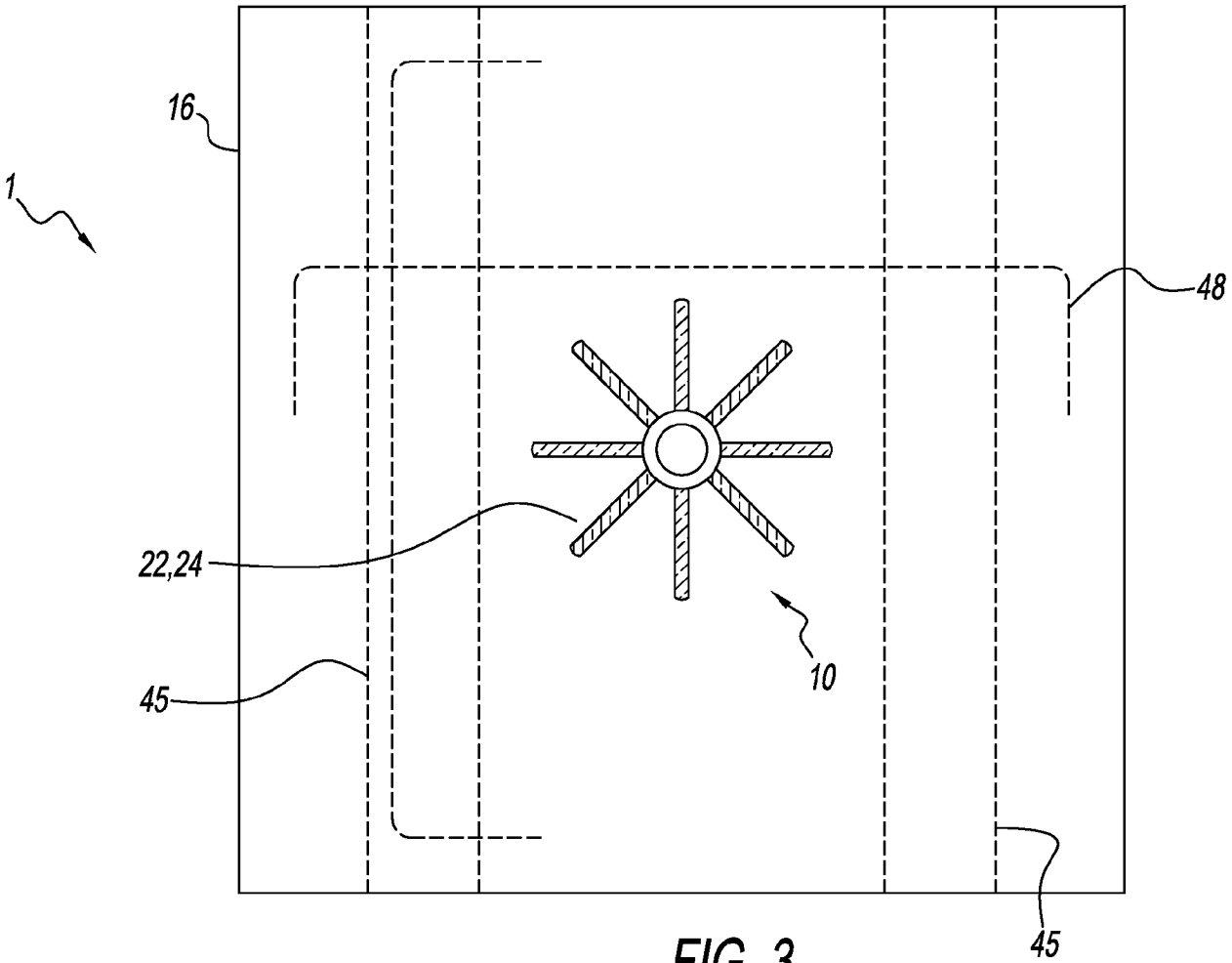
FIG. 3 is a top cutaway view of a twist lock portable building footing with a pocket projection device in accordance with the present invention.

With reference now to the drawings, and particularly to FIG. 1, there is shown a cross sectional view of a twist lock portable building footing 1. With reference to FIGS. 2-3, the twist lock portable building footing 1 preferably includes a block anchor device 10, a threaded adjustment shaft 12, a pocket projection device 14 and a cast concrete block 16. The block anchor device 10 preferably includes a threaded tube 18, a cover plate 20, a plurality of lower rebar projections 22 and a plurality of upper rebar projections 24. The cover plate 20 is welded to a bottom of the threaded tube 18 to prevent the ingress of concrete during casting. The plurality of lower rebar projections 22 are welded around an outer perimeter of the threaded tube 20 near a bottom of the threaded tube 20. Each lower rebar projection 22 discloses a Z-shape, but other shapes may also be used. The plurality of upper rebar projections 24 are welded around an outer perimeter of the threaded tube 20 near a top of the threaded tube 20. Each upper rebar projection 24 discloses a U-shape, but other shapes may also be used. An inner diameter of the threaded tube 20 is sized to threadably engage an outer threaded diameter of the threaded adjustment shaft 12.

The pocket projection device 14 preferably includes a support base 26, an H-shaped spherical roller bearing 28 and a twist lock projection 30. The support base 26 includes an attachment plate 32 and a base threaded tube 34. The base threaded tube 34 is attached to a bottom of the attachment plate 32 with welding or the like. The H-shaped spherical bearing 28 includes a mounted spherical roller bearing 36 and an upper attachment plate 38. The mounted spherical roller bearing 36 includes a spherical bearing tube 40 and a lower mounting flange 42. The upper attachment plate 38 is welded town end of the spherical bearing tube 40. However, the H-shaped spherical bearing 28 may not be necessary, unless a support surface is extremely angular. The twist lock projection 30 includes a twist lock 44 and twist lock mounting plate 46. The twist lock mounting plate 46 is welded to a bottom of the twist lock 44.

The twist lock portable building footing 1 is preferably assembled in the following manner. The block anchor device 10 is cast in the cast concrete block 16 with a rebar cage 48. A pair of forklift slots 45 are preferably formed in a bottom of the cast concrete block 16 to receive a pair of forks from a forklift. One end of the threaded adjustable shaft 12 is threaded into the threaded tube 20 of the pocket projection device 10. The lower mounting flange 42 of the H-shaped spherical bearing 28 is attached to the attachment plate 32 of the support base 26 with a plurality of fasteners 50. The twist lock mounting plate 46 is attached to the upper attachment plate 38 of the H-shaped spherical bearing 28 with a plurality of fasteners 52. The twist lock portable building footings 1 are positioned, such that projection members 54 of the twist locks 44 may be inserted into grappler pockets of a cargo container (not shown).

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

We claim:

1. A twist lock portable building footing comprising:

a block anchor device includes a threaded tube, a plurality of rebar projections, said plurality of rebar projections extend from a perimeter of said threaded tube;

a threaded adjustment shaft having a first end and a second end, an inner diameter of said threaded tube is sized to threadably receive said first end of said threaded adjustment shaft;

a pocket projection device includes a support base, a spherical bearing and a twist lock projection, said support base includes a base threaded tube and an attachment plate, said base threaded tube extends downward from said attachment plate, one end of said spherical bearing is attached to said attachment plate;

said spherical bearing includes a mounted spherical roller bearing and an upper attachment plate, said mounted spherical roller bearing includes a spherical bearing tube, said attachment plate is attached to an end of said spherical bearing tube, said twist lock projection is attached to the other end of said spherical bearing, an inner diameter of said base threaded tube is sized to threadably receive said second end of said threaded adjustment shaft; and a cast concrete block includes said block anchor device formed therein.

2. The twist lock portable building footing of claim 1 wherein:

said plurality of rebar projections include a plurality of lower rebar projections extending from near a bottom of said threaded base; and a plurality of upper rebar projections include a plurality of upper rebar projections extending from near a top of said threaded base.

3. The twist lock portable building footing of claim 1, further comprising:

a rebar cage is formed in said cast concrete block.

4. A twist lock portable building footing comprising:

a block anchor device includes a threaded tube, a plurality of rebar projections, said plurality of rebar projections extend from a perimeter of said threaded tube;

a threaded adjustment shaft having a first end and a second end, an inner diameter of said threaded tube is sized to threadably receive said first end of said threaded adjustment shaft;

a pocket projection device includes a support base, a spherical bearing and a twist lock projection, said support base includes a base threaded tube and an attachment plate, said base threaded tube extends downward from said attachment plate, one end of said spherical bearing is attached to said attachment plate;

said spherical bearing includes a mounted spherical roller bearing and an upper attachment plate, said mounted spherical roller bearing includes a spherical bearing tube, said attachment plate is attached to an end of said spherical bearing tube;

said twist lock projection includes a twist lock and a twist lock mounting plate, said twist lock mounting plate is attached to a bottom of said twist lock, said twist lock mounting plate is attached to said attachment plate, said twist lock mounting plate is attached to the other end of said spherical bearing, an inner diameter of said base threaded tube is sized to threadably receive said second end of said threaded adjustment shaft; and a cast concrete block includes said block anchor device formed therein.

5. The twist lock portable building footing of claim 4 wherein:

said plurality of rebar projections include a plurality of lower rebar projections extending from near a bottom of said threaded base; and a plurality of upper rebar projections include a plurality of upper rebar projections extending from near a top of said threaded base.

6. The twist lock portable building footing of claim 4, further comprising:

a rebar cage is formed in said cast concrete block.

* * * * *